US005567340A

United States Patent [19]

Behler et al.

[11] Patent Number: 5,567,340

[45] Date of Patent: Oct. 22, 1996

[54] NITROGEN-FREE ANIONIC SOFTENERS

[75] Inventors: Ansgar Behler, Bottrop; Uwe Ploog, Haan; Guenther Uphues, Monheim; Bernd Wahle, Kaarst; Peter Waltenberger, Hollig; Yvonne Jansen, Krefeld, all of Germany

[73] Assignee: Henkel Kommanditgesellschaft auf Aktien, Duesseldorf, Germany

[21] Appl. No.: 454,302

[22] PCT Filed: Dec. 9, 1993

[86] PCT No.: PCT/EP93/03469

§ 371 Date: Jun. 16, 1995

§ 102(e) Date: Jun. 16, 1995

[87] PCT Pub. No.: WO94/13768

PCT Pub. Date: Jun. 23, 1994

[30] Foreign Application Priority Data

Dec. 17, 1992 [DE] Germany ..... 42 42 689.8

[51] Int. Cl.[6] ..... D06M 13/148

[52] U.S. Cl. ..... 510/527; 510/516; 510/328

[58] Field of Search ..... 252/8.6, 8.7, 8.9; 554/90

[56] References Cited

U.S. PATENT DOCUMENTS 5,117,032 5/1992 Fabry et al. ..... 558/34
5,312,932 5/1994 Behler et al. ..... 554/90
5,319,117 6/1994 Fabry et al. ..... 554/98

FOREIGN PATENT DOCUMENTS 4038477 6/1992 Germany .
9118871 12/1991 WIPO .
9209570 6/1992 WIPO .

OTHER PUBLICATIONS

Seifen–Öle–Fette–Wachse, 117, 287 and 690 (1991) No Month.

*Primary Examiner*—Anthony Green
*Attorney, Agent, or Firm*—Ernest G. Szoke; Wayne C. Jaeschke; Real J. Grandmaison

[57] ABSTRACT

Nitrogen-free anionic fabric softeners are provided by sulfated fatty acid partial glycerides corresponding fo formula (I):

$$\begin{array}{l} CH_2O-(CH_2CH_2O)_mR^1 \\ | \\ CH-O-(CH_2CH_2O)_nR^2 \\ | \\ CH_2O-(CH_2CH_2O)_pR^3 \end{array} \quad (I)$$

in which $R^1$, $R^2$ and $R^3$ independently of one another represent at least one aliphatic, linear or branched acyl radical containing 6 to 22 carbon atoms, at least one sulfate group and optionally a hydroxyl group, and m, n and p=0 or a number from 1 to 10.

6 Claims, No Drawings

NITROGEN-FREE ANIONIC SOFTENERS

BACKGROUND OF THE INVENTION

1. Field of the Invention

This invention relates to nitrogen-free anionic softeners containing sulfated fatty acid partial glycerides and to the use of the sulfated fatty acid partial glycerides for the production of the softeners.

2. Discussion of Related Art

Cationic or pseudocationic compounds are predominantly used in the softening of textiles, yarns and fibers and also in the finishing of leather and in papermaking. Important representatives of this group are, for example, distearyl dimethyl ammonium chloride (DSDMAC), quaternized difatty acid alkanolamine ester salts or reaction products of fatty acids with polyamines, for example aminoethyl ethanolamine. Although these compounds have excellent softening properties, their biological degradability and the sensitization potential of a number of products are not entirely satisfactory [cf. Seifen-öle-Fette-Wachse, 117, 287 and 690 (1991)]. In addition, the—certainly more theoretical—possibility that nitrosamines can be formed in traces from cationic surfactants in water-containing preparations leads to a market need for softeners which are free from nitrogen-containing compounds.

A number of anionic compounds which also have softening properties and are readily biodegradable are actually known from the extensive prior art relating to softening preparations and fabric softeners. However, the performance level of hitherto known anionic softeners is so low that they have not hitherto been used in commercial products despite their ecotoxicological advantages.

Now, the problem addressed by the present invention was to provide new nitrogen-free anionic softeners which would be free from the disadvantages described above.

DESCRIPTION OF THE INVENTION

The present invention relates to nitrogen-free anionic softeners containing sulfated fatty acid partial glycerides corresponding to formula (I):

$$\begin{array}{l} CH_2O-(CH_2CH_2O)_mR^1 \\ | \\ CH-O-(CH_2CH_2O)_nR^2 \\ | \\ CH_2O-(CH_2CH_2O)_pR^3 \end{array} \quad (I)$$

in which $R^1$, $R^2$ and $R^3$ independently of one another represent at least one aliphatic, linear or branched acyl radical containing 6 to 22 carbon atoms, at least one sulfate group and optionally a hydroxyl group and m, n and p=0 or numbers of 1 to 10.

It has surprisingly been found that sulfated fatty acid partial glycerides have very good softening properties, are readily biodegradable and hence meet all the requirements to be able to be successfully used in softening preparations and fabric softeners.

Starting Materials

The sulfated fatty acid partial glycerides are known substances which may be obtained by relevant methods of preparative organic chemistry. A preferred method comprises, for example, sulfating technical partial glyceride mixtures of high diglyceride content with gaseous sulfur trioxide in continuous falling-film reactors and then introducing the products into and neutralizing them with sodium hydroxide [cf. DE-A1 40 38 477 Henkel].

Accordingly, a fatty acid partial glyceride in the context of the invention is a technical mixture of mono-, di- and triglycerides which may still contain some free glycerol. Mixtures containing 25 to 50% by weight and preferably 35 to 40% by weight of diglyceride, based on the mixture, are preferably used.

Accordingly, the resulting sulfated fatty acid partial glycerides are also technical mixtures which, in addition to sulfated diglycerides, may contain above all monoglyceride sulfates and unsulfonated constituents. The content of sulfated 1,2- or 1,3-diglycerides is preferably from 30 to 60% by weight, based on the anionic surfactant content.

The sulfated fatty acid partial glycerides may also contain ethylene oxide groups in the molecule. Compounds such as these are also known in principle and may be prepared, for example, by ethoxylation of fatty acid partial esters and subsequent sulfation. The sum of the indices m, n and p represents the degree of ethoxylation, each individual index standing for 0 or numbers of 1 to 10 and preferably 2 to 7. Accordingly, the preferred sulfated fatty acid partial glycerides containing ethylene oxide are obtained by sulfation of adducts of, on average, 6 to 21 and more particularly 10 to 15 moles of ethylene oxide with fatty acid partial glycerides. It is pointed out that m, n and p do not necessarily have to show the same values because, in the ethoxylation of fatty acid partial esters, there is competition between the addition of ethylene oxide onto free hydroxyl groups and the insertion into the ester bond. The resulting homolog distribution may also be conventional or narrow, depending on the catalyst used.

The softeners according to the invention preferably contain sulfated fatty acid partial glycerides corresponding to formula (I), in which $R^1$ and $R^3$ are acyl radicals and $R^2$ is a sulfate group or in which $R^1$ and $R^2$ are acyl radicals and $R^3$ is a sulfate group and m, n and p=0. In this context, a "sulfate group" is understood to be an $—SO_3X$ group in which X is ammonium, alkyl ammonium or an alkali metal and/or alkaline earth metal, preferably sodium.

Other preferred softeners are those which contain sulfated fatty acid partial glycerides corresponding to formula (I), in which $R^1$, $R^2$ and $R^3$ independently of one another represent at least one acyl radical containing 16 to 18 carbon atoms and m, n and p=0.

Nitrogen-free anionic softeners containing sulfated diglycerides based on $C_{16/18}$ tallow fatty acid have proved to be particularly advantageous in regard to their softening properties. The tallow fatty acid component may be saturated, partly saturated or predominantly unsaturated.

The nitrogen-free anionic softeners according to the invention usually contain the sulfated fatty acid partial glycerides corresponding to formula (I) in quantities of 1 to 100% by weight and preferably in quantities of 50 to 95% by weight, based on the solids content of the softeners. The softeners themselves are generally marketed in the form of water-based concentrates containing 30 to 70% by weight of solids or in the form of flakes. In addition to the sulfated fatty acid partial glycerides mentioned, they may contain other typical auxiliaries and additives in the usual quantities, including for example dispersants, fragrances and viscosity regulators.

Industrial Applications

The sulfated fatty acid partial glycerides present in the softeners according to the invention are ecotoxicologically very safe and provide sheet-form textiles and also leather and paper with a pleasant soft feel. Accordingly, the softeners according to the invention may be used, for example, for the continuous or discontinuous treatment of textiles.

Accordingly, the present invention also relates to their use for the production of fabric conditioners and softeners in which they may be present in quantities of 1 to 70% by weight, preferably 10 to 50% by weight and, more preferably, 15 to 30% by weight, based on the conditioner/softener. In addition, the fabric conditioners and softeners according to the invention may contain other typical additives such as, for example, surfactants, emulsifiers, synthetic resins, catalysts and optical brighteners.

The following Examples are intended to illustrate the invention without limiting it in any way.

EXAMPLES

I. Production Example

Sulfonation of $C_{16/18}$ Tallow Fatty Acid Diglyceride.

In a continuous falling-film reactor (length 120 cm, cross-section 1 cm, educt throughput 600 g/h) equipped with a cooling jacket and a lateral inlet for $SO_3$ gas, 2780 g (5 moles) of a technical diglyceride having the following composition:

| | |
|---|---|
| Monoglyceride | 15.1% by weight |
| Diglyceride | 38.3% by weight |
| Triglyceride | 38.0% by weight |
| Hydroxyl value | 97 |
| Saponification value | 187 |
| Acid value | 2.6 |
| Iodine value | 41 |

were reacted with sulfur trioxide at 95° C. The molar ratio of $SO_3$ to hydroxyl groups present in the partial glyceride was 0.95:1. The sulfur trioxide was driven out by heating from a corresponding quantity of 65% by weight oleum, diluted with nitrogen to a concentration of 5% by volume and contacted with the diglyceride film through a nozzle. The crude sulfonation product was then stirred with 37% by weight sodium hydroxide solution into a 1% by weight solution of sodium triphosphate and neutralized at pH =6.5 to 8.

| Characteristic data of the product: | |
|---|---|
| Anionic surfactant content (Epton) | 21.3% by weight (MW = 680.5) |
| Unsulfonated | 10.1% by weight |
| Sodium sulfate | 1.4% by weight |
| Water | 61.2% by weight |

The anionic surfactant content (WAS) and the unsulfonated constituents (US) were determined in accordance with DGF-Einheitsmethoden, Stuttgart 1950–1984, H-III-10 and G-II-6b.

II. Application Example

The softening effect of product (A) according to the invention was determined by forced application to a cotton fabric by the padding process. Softening performance was determined by feel by a test panel of 6 people. A commercial softener based on a fatty acid polyamine condensate (B) was used for comparison. The following parameters were established:

| | |
|---|---|
| Concentration | 30 g/l of the 20% by weight products |
| Material | terry |
| Liquor uptake | about 80% by weight, based on dry fabric |
| Drying | 3 mins. at 130° C. |

The results are set out in Table 1.

TABLE 1

Determination of softening performance

| Softener | Feel score |
|---|---|
| A | 5.5 |
| B | 5.0 |

Legend:
Feel score 1 = hard
Feel score 6 = very soft

We claim:

1. The process of softening textiles, yarns or fibers comprising contacting said textiles, yarns or fibers with a nitrogen-free anionic softener comprising sulfated fatty acid partial glycerides corresponding to formula (I):

$$\begin{array}{l} CH_2O-(CH_2CH_2O)_mR^1 \\ | \\ CH-O-(CH_2CH_2O)_nR^2 \\ | \\ CH_2O-(CH_2CH_2O)_pR^3 \end{array} \quad (I)$$

in which $R^1$, $R^2$ and $R^3$ independently of one another represent at least one aliphatic, linear or branched acyl radical containing 6 to 22 carbon atoms, at least one sulfate group and optionally a hydroxyl group, and m, n and p=0 or a number from 1 to 10.

2. A process as in claim 1 wherein in said sulfated fatty acid partial glycerides $R^1$ and $R^3$ are acyl radicals, $R^2$ is a sulfate group and m, n and p=0.

3. A process as in claim 1 wherein in said sulfated fatty acid partial glycerides $R^1$ and $R^2$ are acyl radicals, $R^3$ is a sulfate group and m, n and p=0.

4. A process as in claim 1 wherein in said sulfated fatty acid partial glycerides $R^1$, $R^2$ and $R^3$ independently of one another represent at least one $C_{16-18}$ acyl radical and m, n and p=0.

5. A process as in claim 1 wherein said sulfated fatty acid partial glycerides are derived from $C_{16}$–$C_{18}$ tallow fatty acid sulfated diglycerides.

6. A process as in claim 1 wherein said sulfated fatty acid partial glycerides are present in a quantity of from 1 to 100% by weight, based on the solids content of said softener.

* * * * *